US006648488B1

(12) United States Patent
Pearce

(10) Patent No.: US 6,648,488 B1
(45) Date of Patent: Nov. 18, 2003

(54) QUICK MOUNT LIGHTING ASSEMBLY FOR CEILING FANS

(75) Inventor: Richard A. Pearce, Memphis, TN (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 10/173,232

(22) Filed: Jun. 14, 2002

(51) Int. Cl.[7] ..... F21V 33/00

(52) U.S. Cl. ..... 362/96; 362/147; 362/226; 362/404; 416/5

(58) Field of Search ..... 362/96, 147, 226, 362/404, 234, 249, 457; 416/5

(56) References Cited

U.S. PATENT DOCUMENTS 5,664,872 A * 9/1997 Spearman et al. ..... 362/96
6,062,816 A * 5/2000 Chang ..... 362/249
6,086,226 A * 7/2000 Chang ..... 362/294
6,322,232 B1 * 11/2001 Oliver ..... 362/147
6,494,589 B1 * 12/2002 Shyu ..... 362/96

* cited by examiner

*Primary Examiner*—Laura K. Tso
(74) *Attorney, Agent, or Firm*—Baker Donelson

(57) ABSTRACT

A ceiling fan having a set of fan blades rotatably coupled with an electric motor housed within a motor housing, a switch housing mounted below said set of fan blades, a plurality of spring clips of an electric socket in an array about a threaded mounting channel, a light kit having an electric plug with a plurality of terminal blades sized and arranged about a central plug passageway to be plugged into said switch housing socket spring clips, and a bolt sized to be passed through said light kit electric plug passageway and threaded into said switch housing threaded channel in mounting the light kit beneath the switch housing.

6 Claims, 2 Drawing Sheets

QUICK MOUNT LIGHTING ASSEMBLY FOR CEILING FANS

TECHNICAL FIELD

This invention relates generally to electrically powered ceiling fans, and more specifically to ceiling fans that have one or more lamps.

BACKGROUND OF THE INVENTION

Electrically powered ceiling fans often have a lamp or several lamps located beneath the fan blades and their orbital path of travel. Fan manufacturers have designed such fans so that light kits of different shapes and styles, and with different numbers of lamps, may be selected by the consumer at retail and mounted to the fan body during fan installation. The light kit is mounted to the fan only after the fan itself has been mounted to the ceiling and its switch housing wired to the building wiring in the ceiling as through a tubular down rod. Power to both the fan motor and fan lamp is thus run through the switch housing.

Heretofore light kits have been mounted to the fan following fan installation by connecting its wires to wires within the switch housing as with insulated connecters or tape. Mechanical connection has then been made with screws passed through holes in the sides of the light kit and the switch housing while taking care that the wiring remains bundled properly within both the switch housing and light kit. This has all had to be done by the installer while working overhead on a ladder from below. Often the installer, at least of the light kit itself, is the consumer itself rather than a professional electrician. The task of light kit installation thus has proven to be rather difficult, tedious, and slow. Furthermore, once the light kit is installed it is difficult to change the light kit to another design.

Accordingly, it is seen that a need has long existed for a ceiling light kit that could be more easily and quickly mounted a fan. It thus is to the provision of such that the present invention is primarily directed.

SUMMARY OF THE INVENTION

In a preferred form of the invention a quick mount lighting assembly is provided for a ceiling fan that has a switch housing that houses an electrical connector electrically connectable to a municipal power source and a threaded mechanical connector. The quick mount lighting assembly comprises a light kit housing with a bottom opening that may be positioned adjacent the ceiling fan switch housing with the housing opening providing external access to a switch housing mechanical connector. An electric connector is mounted in the light kit housing electrically connected to at least one lamp socket supported on the kit housing. The assembly also has a knob with a threaded shank sized to be passed through the light kit housing opening and threaded onto the switch housing mechanical connector. So constructed, the lighting assembly may be quickly mounted to the ceiling fan by placing the light kit housing adjacent to or against the fan switch housing with the light kit electrical connector connected with the switch housing electrical connector and with the knob shank passed through the light kit housing opening and threaded into the light switch mechanical connector.

In another preferred form of the invention a ceiling fan having a set of fan blades rotatably coupled with an electric motor housed within a motor housing, a switch housing mounted below the fan blades and a plurality of spring clips of an electric socket in an array about a threaded channel. The fan also has a light kit with an electrical plug with terminal blades sized and arranged about a central plug passageway to be plugged into the switch housing socket spring clips. A bolt is provided that is sized to be passed through the light kit electric plug passageway and threaded into the switch housing threaded channel in mounting the light kit beneath the switch housing.

DETAILED DESCRIPTION

Figure 1:
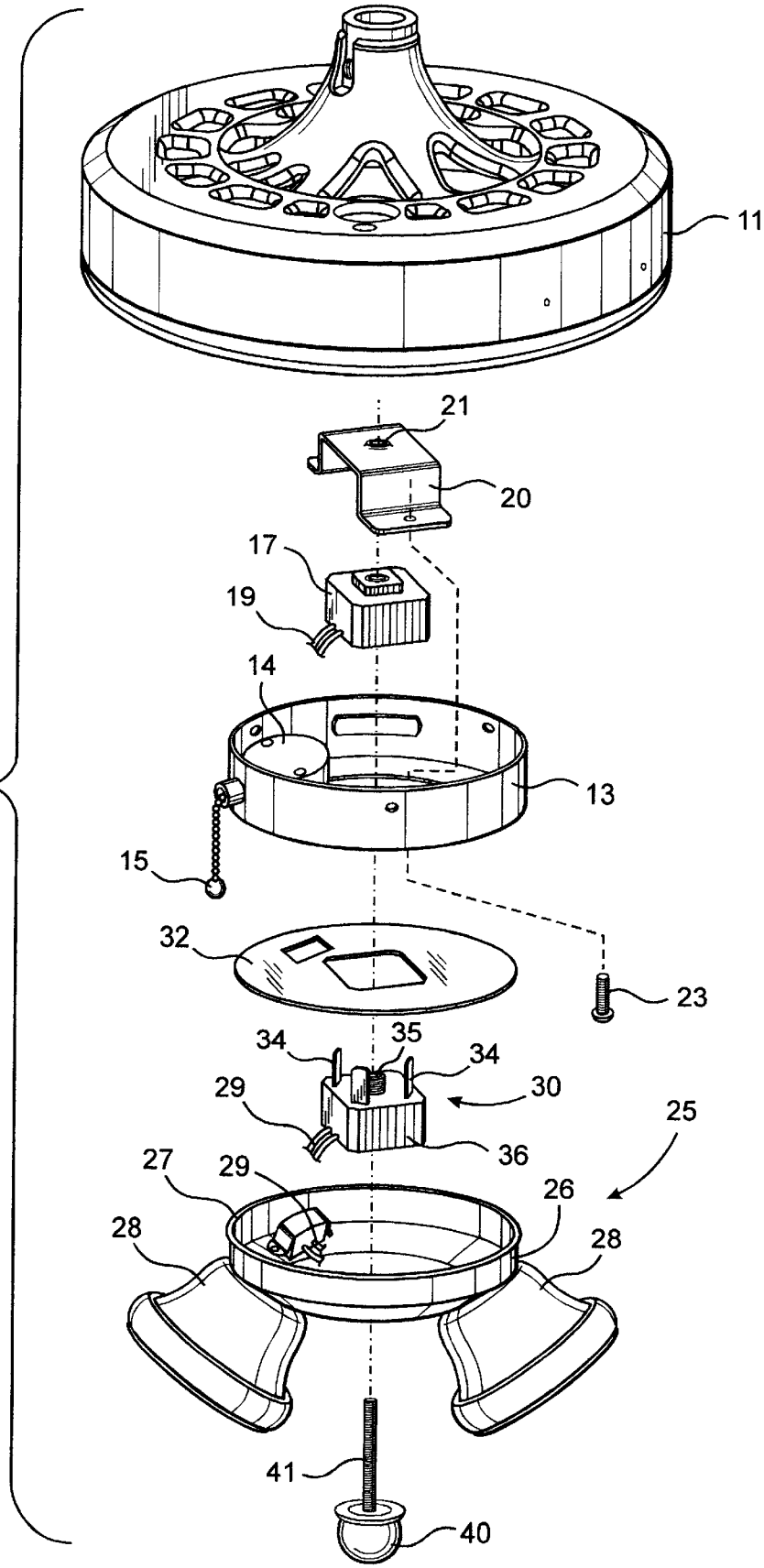
FIG. 1 is an exploded view, in perspective, of a ceiling fan and quick mount lighting assembly that embodies the invention in its preferred form.

Referring now in more detail to the drawing there is shown a ceiling fan having a conventional fan motor housing 11. An unshown electric motor is housed within the housing 11 that rotates a set of unshown fan blades in an orbital path of travel below the housing. The housing is mounted to a downrod from a room ceiling through which electrical wires extend from the motor to a source of municipal power via a fan switch.

A fan switch housing 13 is conventionally mounted beneath the motor housing which houses a fan power switch 14 that may be manually operated by a pull chain 15. A socket 17 with spring clip electric terminals 18 is also mounted in the switch housing 13 by a mounting bracket 20 and threaded nipple 21 by screws 23. Electric wiring 19 extends from the socket to the switch 14 where the switch 14 controls both the fan and fan lights. The socket has a central passage therethrough with a tapered wall 22.

A light kit 25 is shown mounted below the motor housing 11. It has an open top dish shaped housing 26 with an annular rim 27 to which lamp sockets 28 are mounted to receive unshown light bulbs. These are connected by wires 29 to a plug 30 that is mounted to the kit housing 26 beneath an isolator 32. The plug has three electric blade terminals 34 mounted in an array about a centering tube 35 that is threaded through a central channel through the plug housing 36. Finally, the lighting assembly has a knob 40 with a threaded shank 41.

Figure 2:
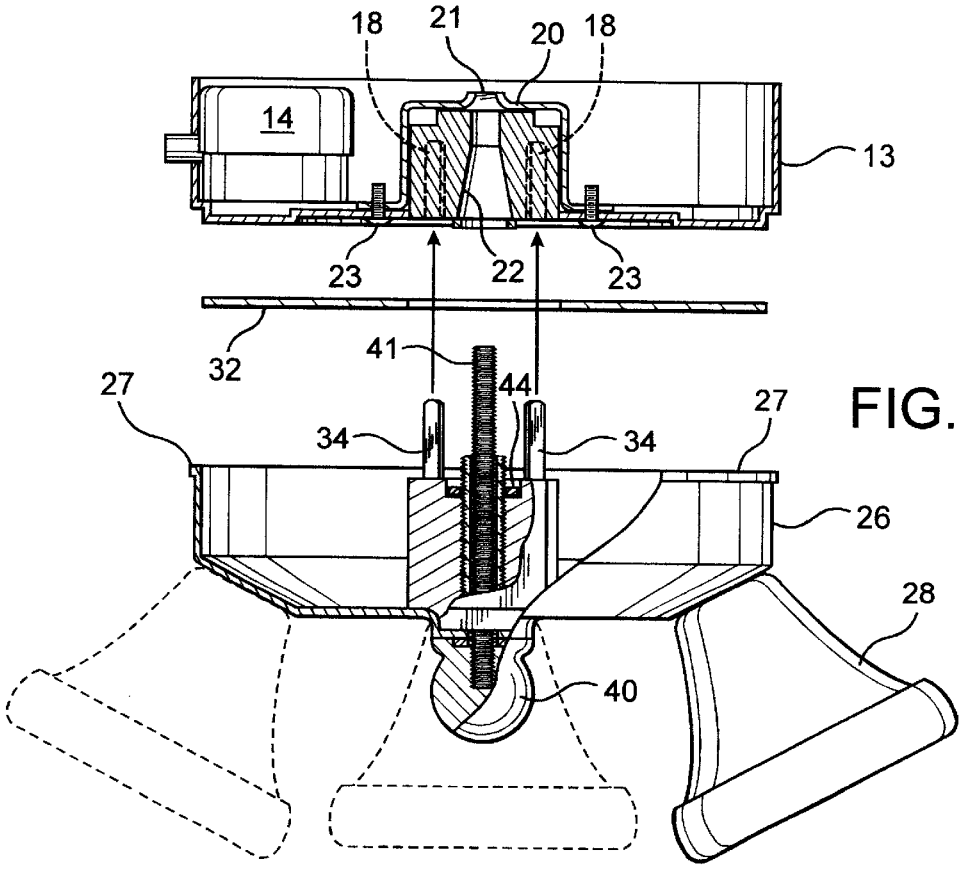
FIG. 2 is a side view, in cross-section, of the ceiling fan switch housing and quick mount lighting assembly shown positioned for mounting.
Figure 3:
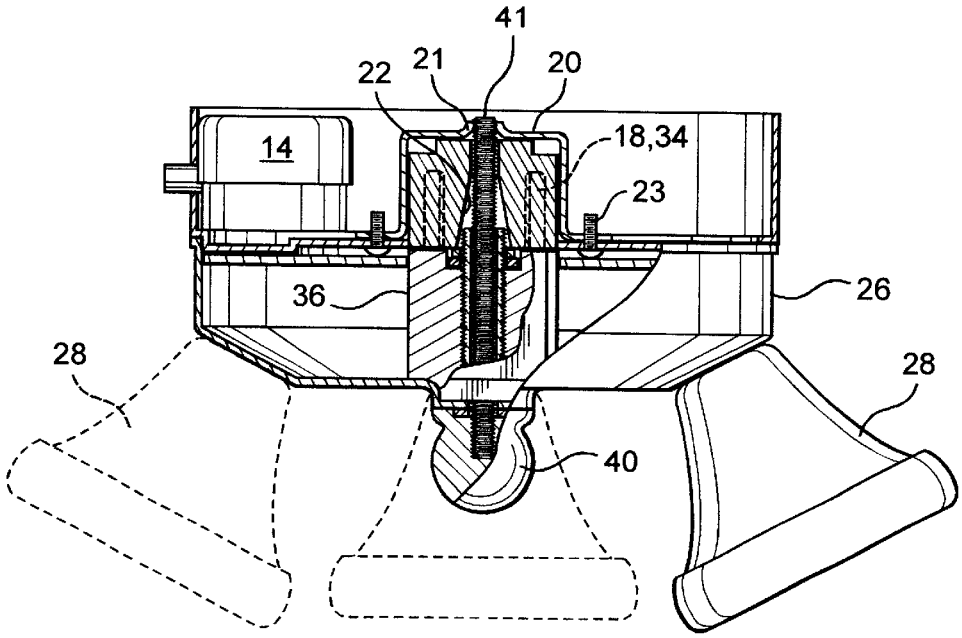
FIG. 3 is a side view, in cross-section, of the ceiling fan switch housing with the lighting assembly shown electrically and mechanically mounted thereto.

To mount the light kit 25 to the fan switch housing 13 its housing 27 is simply raised upwardly from its position shown in FIG. 2 to that shown in FIG. 3. In doing so the plug terminal blades 34 enter the socket spring clip terminals 18 and the threaded shank 41 of the knob helps engage the inside tapered wall 22 of the socket. As this occurs the rim 27 of the light kit becomes seated in an annular recess of the switch housing. This establishes electrical connection of the light kit with the fan switch housing.

As electrical connection is being made the knob shank, which has been loosely held to the light kit by a retainer clip 44, has been guided by contact with the tapered socket wall 22 into alignment with the threaded nipple 21 of the socket mounting bracket 20.

The knob 40 is then used to mechanically secure the light kit by threading its shank 41 into the internal threads of the bracket nipple 21. This is continued until the knob itself has been brought flush against the bottom of the light kit housing. Should it later be desirable to remove the light kit the knob 40 is simply unthreaded and the kit plug pulled out of the socket.

It should be understood that once the light kit is mounted it may be removed and replaced by a light kit of another design. As such, lights kits may be quickly and easily changed, a feature that would enable a consumer to change light kits for special occasions or events such as birthdays and holidays.

It thus is seen that a lighting assembly is now provided for a ceiling fan that may be mounted and dismounted quickly and with ease. Though the mechanical mount is achieved with a hand knob with threaded shank, the knob itself could be replaced with a bolt, flange or other like that flares outwardly from the shank to underlay the light kit housing. Other modifications, additions or deletions may of course be made without departure from the spirit and scope of the invention as set forth in the following claims.

What is claimed is:

1. A quick mount lighting assembly for a ceiling fan that has a switch housing that houses an electrical connector electrically connectable to a municipal power source and a threaded mechanical connector, and with said quick mount lighting assembly comprising a light kit housing with a bottom opening that may be positioned adjacent the ceiling fan switch housing with said housing opening providing external access to the switch housing mechanical connector, an electric connector mounted in said light kit housing electrically connected to at least one lamp socket, and a knob with a threaded shank sized to be passed through said light kit housing opening and threaded onto the switch housing threaded mechanical connector, whereby the lighting assembly may be quickly mounted to the ceiling fan by placing the light kit housing adjacent the fan switch housing with the light kit electrical connector connected with the switch housing electrical connector and with the knob shank passed through the light kit housing opening and threaded into the light switch mechanical connector.

2. The lighting assembly of claim 1 wherein said light kit housing is generally dish shaped.

3. The lighting assembly of claim 1 wherein the fan switch housing electrical connector is an electric socket and wherein said light kit electrical connector is an electric plug.

4. The lighting assembly of claim 1 wherein the fan switch housing threaded mechanical connector has internal screws threads and wherein said threaded knob has external screw threads.

5. The lighting assembly of claim 1 wherein the fan switch housing electric connector is an electric socket having an array of electric connectors located about said switch housing mechanical connector, and wherein said light kit electric connector is an electric plug having an array of blade terminals located about said light kit mechanical connector.

6. A ceiling fan having a set of fan blades rotatably coupled with an electric motor housed within a motor housing, a switch housing mounted below said set of fan blades, a plurality of spring clips of an electric socket in an array about a threaded mounting channel, a light kit having an electric plug with a plurality of terminal blades sized and arranged about a central plug passageway to be plugged into said switch housing socket spring clips, and a bolt sized to be passed through said light kit electric plug passageway and threaded into said switch housing threaded channel in mounting the light kit beneath the switch housing.

* * * * *